United States Patent [19]

Luce et al.

[11] 3,991,645

[45] Nov. 16, 1976

[54] ELECTRONIC MUSICAL INSTRUMENT WITH EXPONENTIAL KEYBOARD AND VOLTAGE CONTROLLED OSCILLATOR

[75] Inventor: David A. Luce, Clarence Center, N.Y.

[73] Assignee: Norlin Music, Inc., Lincolnwood, Ill.

[22] Filed: June 14, 1975

[21] Appl. No.: 479,444

[52] U.S. Cl. ..... 84/1.01; 84/454; 84/DIG. 8; 84/DIG. 18; 84/DIG. 20

[51] Int. Cl.[2] ..... G10H 1/00; G10H 5/04

[58] Field of Search ..... 84/1.01, 1.24, 4.54, 84/DIG. 2, DIG. 8, DIG. 10, DIG. 18, DIG. 20

[56] References Cited

UNITED STATES PATENTS

| | | | |
|---|---|---|---|
| 3,283,057 | 11/1966 | Campbell, Jr. | 84/1.01 |
| 3,288,904 | 11/1966 | George | 84/1.01 |
| 3,347,973 | 10/1967 | Freeman | 84/1.24 |
| 3,490,327 | 1/1970 | Volpe | 84/1.01 X |
| 3,715,444 | 2/1973 | Pearlman | 84/1.01 |
| 3,733,955 | 5/1973 | Reinagel et al. | 84/1.01 |
| 3,767,833 | 10/1973 | Noble et al. | 84/1.01 |
| 3,786,166 | 1/1974 | Mieda | 84/1.01 |
| 3,828,108 | 8/1974 | Thompson | 84/1.01 |
| 3,878,754 | 4/1975 | Barnum | 84/DIG. 18 |
| R27,983 | 4/1974 | Stearns | 84/1.01 |

OTHER PUBLICATIONS

R. G. Hibberd, INTEGRATED CIRCUITS, McGraw-Hill Book Co., copyright 1969, pp. 1–11.

*Primary Examiner*—Stanley J. Witkowski
*Attorney, Agent, or Firm*—Hill, Gross, Simpson, Van Santen, Steadman, Chiara & Simpson

[57] ABSTRACT

An electronic musical instrument includes an oscillator for generating a signal at a frequency corresponding to that associated with a depressed key of the keyboard. The key selects a control voltage, from an exponential voltage divider, for controlling the frequency of a voltage controlled oscillator, which produces a frequency which is directly proportional to the control voltage and inversely proportional to a reference voltage. The reference voltage compensates for variations in the level of the supply voltage, so that the oscillator frequency is independent of the supply voltage.

10 Claims, 4 Drawing Figures

KEYBOARD
10
HIGH FREQ. GENERATOR
8
SWITCHES
12
S/H
13
5
6
32
TRIGGER UNIT
7
OCTAVE SELECTOR
29
9
30
31
EXP. VOLTAGE DIVIDER
14
4
33
OSC. A
38'
34
41
TUNING UNIT
42
43
OSC. B
46
MIX.
48
50
51
52
54
44
39
38
38"
REF. VOLTAGE
36
40

33
176
174
178
170
210
212
214
180
182
208
206
172
204
184
38'
+V
192
34
190
198
194
196
200
202
38
188
186
36
38"
220
222
224
226
44
234
236
228
42
223
225
232'
230
232
244
246
248
258
260
262
51
48
234'
176a
240
252
254
256
46
242
238

+V
9
69
89
60
76
88
29
78
90
31
80
12
14
15
68
96
16
67
86
94
17
66
18
65
84
92
19
74
64
MV
8
98
20
63
82
72
21
62
70
91
+V
22
61
104
102a
23
100
144
105
24
25
146
106
28
27
26
+V
+V
111
150
32
102
13
107
154
162
33
113
112
147
149
152
160
120
108
109
164
156
158
-V
114
138
136
130
7
126
124
+V
34
128
122
118
140
132
116
+V

ELECTRONIC MUSICAL INSTRUMENT WITH EXPONENTIAL KEYBOARD AND VOLTAGE CONTROLLED OSCILLATOR

BACKGROUND

1. Field of the Invention

The present invention relates to electronic musical instruments, and more particularly to the class of such instruments known as synthesizers.

2. The Prior Art

Electronic music synthesizers generally include an oscillator with means for selectively controlling the frequency produced by the oscillator, so that the output of the oscillator may be caused to produce musical tones and sounds. One component of a synthesizer is a tunable oscillator, and it is important that the oscillator remain in tune, without varying as a result of changes in temperature and other environmental conditions. If the oscillator does not inherently have the required stability, it must frequently be retuned, which is an inconvenience. In addition, rapid changes in tune (e.g., during warming up) are musically unsatisfactory.

In one class of synthesizers, a voltage divider is employed with several taps which are selected individually in accordance with the frequency of the signal which is desired to be produced by the oscillator. It is conventional to construct such a voltage divider by connecting in series several components which all have the same resistance, so that an equal voltage difference is developed by each change in the position of a selected tap, connected to the junction of adjacent components. It is necessary to use an oscillator arrangement which produces a frequency which is an exponential function of the control voltage, so that twelve successive taps produce the frequencies corresponding to the various notes of one octave of the musical scale.

Several designs for oscillators which have the required exponential function have been developed. In one such design, the oscillator is provided with a function generator for developing an exponential function in response to a linear input voltage, and a linear oscillator is controlled by the output of the function generator. This design has not been completely successful, because the function generator and the oscillator are both responsive to changes in the environmental condition, such as temperature, power supply voltage level, etc., and so the required stability has not been attained.

It is, therefore, desirable to produce a system in which the aforementioned disadvantages are overcome.

SUMMARY OF THE PRESENT INVENTION

It is a principal object of the present invention to provide means for generating a variable frequency signal in response to depression of one of a plurality of keys of the keyboard, in which there is a high degree of compensation for changes in environmental conditions, such as changes in the ambient temperature and in the supply voltage.

This and other objects and advantages of the present invention will become manifest upon an examination of the following description and the accompanying drawings.

In one embodiment of the present invention, there is provided an electronic musical instrument having a keyboard with a plurality of keys for selecting the pitches of musical sounds to be produced, a plurality of switches individually associated with the keys of said keyboard, a voltage divider having a plurality of resistance elements which are exponentially related to each other and connected with the switches to produce a control voltage, the level of which is a function of the supply voltage and the operated key, means for developing a reference voltage in response to said supply voltage, whereby a fractional variation in the supply voltage produces a proportionately equal and opposite fractional variation in the reference voltage, and oscillator means connected to said control voltage and to said reference voltage for developing a signal having a frequency proportional to the control voltage and inversely proportional to the reference voltage.

BRIEF DESCRIPTION OF THE DRAWINGS

Reference will now be made to the accompanying drawings, in which.

DESCRIPTION OF THE PREFERRED EMBODIMENTS

Figure 1:
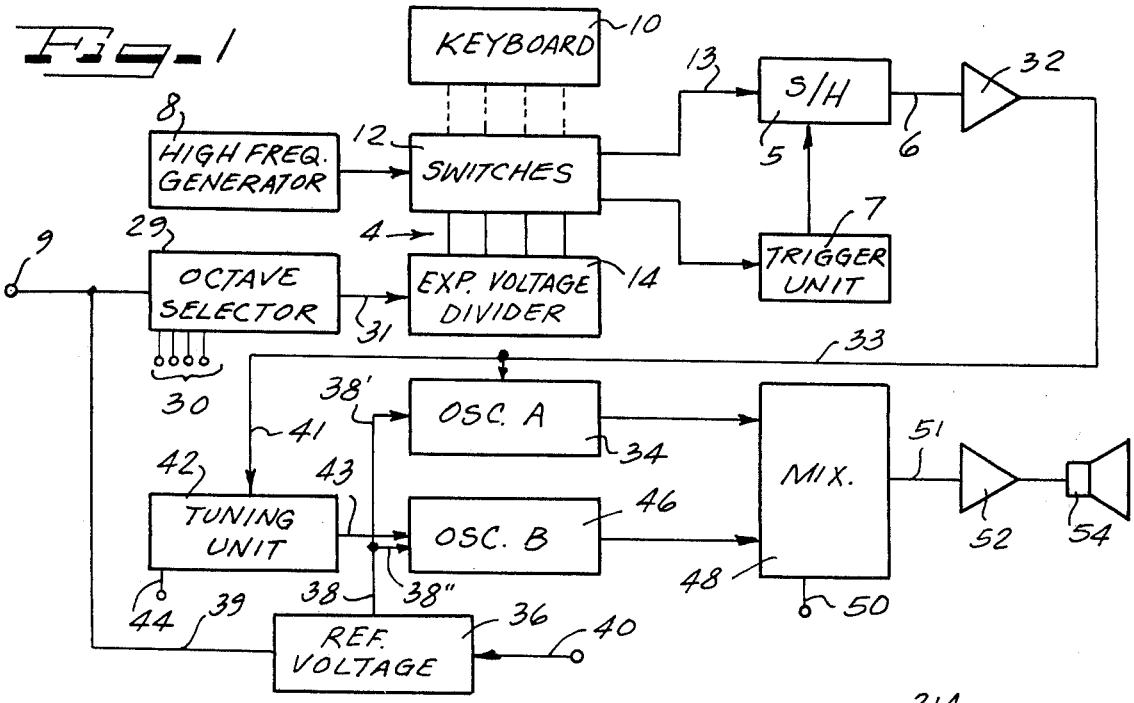
FIG. 1 is a functional block diagram, partly in schematic circuit diagram form, comprising an illustrative embodiment of the present invention.

Referring now to FIG. 1, a functional block diagram of an electronic musical instrument incorporating an illustrative embodiment of the present invention is illustrated. The system of FIG. 1 includes a keyboard 10 having a plurality of switches 12 associated therewith in conventional fashion. When each key of the keyboard 10 is depressed, one of the switches 12 is closed. An exponential voltage divider 14 is associated with the switches 12, and one of a plurality of leads 4 connected to the taps of the voltage divider 14 is connected by an individual switch 12 to a sample and hold unit 5, via a line 13. The unit 5 manifests, on an output line 6, the voltage present on the line 13, which is dependent upon the operated switch 12. The sample and hold unit 5 has a triggering unit 7 which is connected with the switches 12 and which is responsive to closing thereof for activating the sample and hold unit 5.

Figure 2:
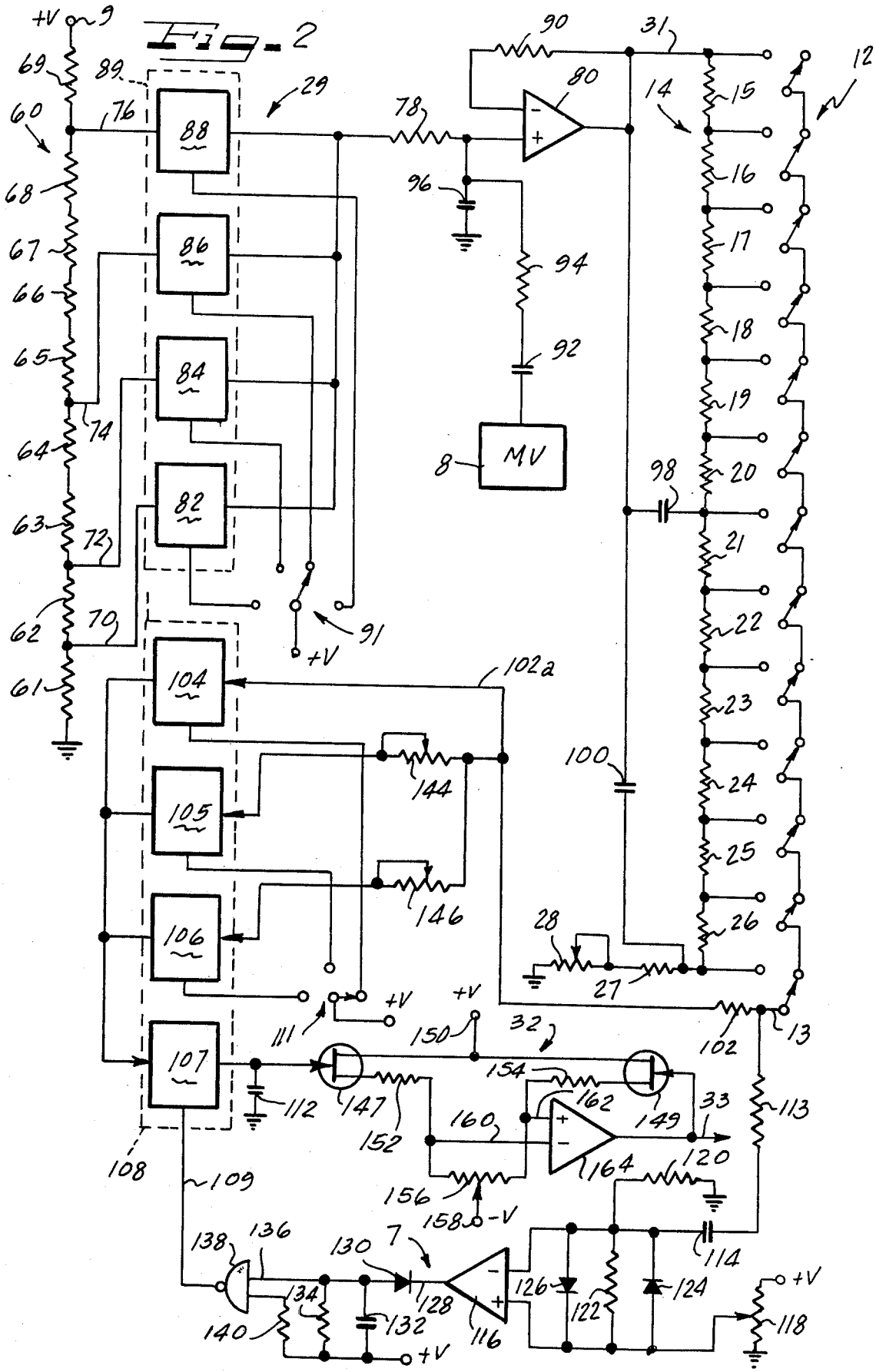
FIG. 2 is a schematic circuit diagram, partly in functional block diagram form, of a keyboard circuit of the apparatus of FIG. 1.

The exponential voltage divider 14 is made up of a series of resistors, as shown in FIG. 2, the resistance values of which are related in a geometric series, so that the value of the voltage at the taps of the voltage divider (between the pairs of adjacent resistors) has an exponential relationship, i.e. the voltages at the taps are approximately directly proportional to the frequencies of the notes of the musical scale.

A high frequency generator 8 is also associated with the switches 12. The generator 8 produces a high frequency signal which is detected by the triggering unit 7, so that the triggering unit's operation is not dependent upon the voltage level at the selected tap of the voltage divider 14.

The input voltage applied to the exponential voltage divider is developed from a power supply voltage applied to a terminal 9. A fraction of this voltage is selected by an octave selector mechanism 29, in response to energization of a plurality of control lines 30. Accordingly, the potential on the output line 6 of the sample and hold unit 5 is responsive not only to which of the switches 12 is operated, but also to the selected octave, under the control of the lines 30.

The line 6 is connected to the input of an amplifier 32, and the output of the amplifier 32 is connected by a line 33 to one input of a first oscillator 34, sometimes hereinafter referred to as the A oscillator. The second input of the oscillator 34 is derived from a reference voltage generator 36, which generates a reference voltage on a line 38. A line 39 connects the reference voltage generator 36 to the power supply potential applied to the terminal 9. The potential on a control line 40 slightly modifies the production of the reference voltage, to allow for the fine tuning of the frequency of the first oscillator 34.

The output of the amplifier 32 is connected by a line 41 to a tuning unit 42. The output of the tuning unit 42, which appears on a line 43, consists of a voltage level which varies from the voltage level present on the line 41 by a given fractional amount. The specific amount of difference is controlled by a control line 44. The output line 43 is connected to one input of the second oscillator 46 (oscillator B). The second input of the second oscillator is connected to the output of the reference voltage generator 36 via line 38.

The outputs of the first and second oscillators 34 and 46 are supplied to two inputs of a mixer 48, the operation of which is controlled by means of a signal applied to a control line 50. The mixer output appears on a line 51, which is connected to a power amplifier 52. The output of the amplifier 52 is connected to a loudspeaker 54, so that sound waves are produced in response to the electrical signals generated by the oscillators 34 and 46.

The purpose of the tuning unit 42 is to cause the second oscillator 46 to operate at a frequency different from that of the first oscillator 34, so that the combination of one or both oscillators, under control of the mixer 48, can result in the production of a variety of sounds at the loudspeaker 54.

Reference will now be made to FIG. 2, which constitutes a schematic circuit diagram of the apparatus associated with the keyboard. The switches 12 associated with the keyboard 10 each comprise a single-pole, double throw switch, and the movable contact of each of the switches is normally connected with one of the fixed contacts, as illustrated. The normally closed fixed contact of each switch is connected in series with the movable contact of the next, so that normally a complete series circuit is closed throughout the switches 12. Operation of any of the switches 12 effectively disconnects the switches above the operated switch, and instead connects the lower portion of the series circuit to a tap of the voltage divider 14. The lower portion of the circuit is connected to an output line 13, via the lowest switch 12, and the tap to which the line 13 is connected is the tap associated with the operated switch.

The voltage divider 14 is comprised of a number of individual resistors 15-28, which are selected to have resistances which have a predetermined relationship to each other. All of the resistors 15–28 are connected to series between an input line 31 and ground, and the taps of the voltage divider are connected to the junctions of adjacent resistors. These taps are each connected to the normally open fixed contact of one of the switches 12. Resistors 27 and 28 together total precisely the sum of the resistances of the resistors 15–26, so that the bottom one of the switches 12 illustrated in FIG. 2 produces a potential on the line 13 which is precisely half of that produced when the uppermost switch 12 is actuated. Because of the exponential relationship of the resistors 15–26, closing various ones of the switches 12 produces a voltage on the output line 13 which varies as an exponential function of the position of the tap associated with that switch. Altogether, thirteen switches 12 are provided, and correspond to the notes of one entire octave plus one note of a musical scale, with upper and lower switches 12 being associated with two keys of the keyboard which are one octave apart. The intervening notes of the scale correspond to the intervening switches. The resistor 28 is made adjustable so that the octave relationship of the upper and lower switches can be precisely adjusted and maintained, by making the sum of the resistance of resistors 27 and 28 equal to the sum of resistances of resistors 15–26.

All of the resistors 15–27 are preferably formed at the same time, by the same manufacturing process, in an integral package, and are in close physical relationship to each other, so that all of them are equally subject to any change in environmental conditions. Thus, the relative voltages developed at the various taps of the voltage divider 14 maintain the same relationship independently of the effects of temperature and changes in the voltage supplied to the input line 31. Manufacturing techniques for producing a variety of resistors together in the same package are well known and will not be explained in detail herein. In a preferred form, they are all formed simultaneously in a single thick-film integrated circuit, so that their temperatures are always equal and their temperature characteristics are also precisely equal.

The voltage applied to the line 31 is selected by the octave selector unit 29. The octave selector unit incorporates a voltage divider 60 which is made up of a number of resistors 61–69 in a thickfilm integrated circuit. The resistors 61–68 are all equal, and the resistance of the resistor 69 may be different, in accordance with the potential of the supply voltage. The voltage divider is connected between the terminal 9 and ground, and leads 70, 72, 74, and 76 are connected respectively to the junctions of resistors 61 and 62, 62 and 63, 64 and 65, and 68 and 69. Because the resistors 61–68 are all equal in resistance value, the potentials which are produced on the lines 70, 72, 74, and 76 differ from each other by factors of powers of two, with each line carrying a voltage which is precisely twice that of the line below it. The four lines 70, 72, 74, and 76 are connected to the inputs of four analog gates 82, 84, 86, and 88, the outputs of which are connected in common through a resistor 78 to the noninverting input of an operational amplifier 80. The four gates 82, 84, 86, and 88 are conveniently packaged together in a single integrated circuit package 89.

The output of the operational amplifier 80 is connected to the line 31, so that the potential on the line 31 depends on which of the four gates 82, 84, 86, and 88 is actuated. A separated control input is provided for each of the four gates 82, 84, 86, and 88, and one of these control outputs is energized with an operating voltage, selected by means of a manually operated switch 91 or an equivalent nonmanual switch, in order to select one of the four lines 70, 72, 74, and 76 for connection with the amplifier 80. The switch 91 is operated by the player to select the desired octave. A feedback resistor 90 is provided for the amplifier 80, and is connected between its output and its inverting input to make the voltage level at the output of the amplifier independent of the open loop gain of the amplifier and to compensate for input bias current effects.

A multivibrator 8 is coupled to the non-inverting input of the amplifier 80 through a capacitor 92 and a resistor 94. A capacitor 96 provides for high frequency roll off of the signals produced by the multivibrator 8.

The multivibrator 8 is adapted to oscillate at a frequency of about 35 kHz, well above audio frequency. It produces a signal which is sensed by the trigger unit 7 in order to detect the moment when a key is depressed, irrespective of the voltage level which may appear on the output line 13.

The sum of the 35 kHz signal and the octave voltage selected by the gates 89 is impedance buffered by the amplifier 80 and is made available at its output on the line 31. The line 31 is directly connected to the tap of the voltage divider 14 and is also capacitively coupled to the mid-point of the voltage divider 14 by a capacitor 98 and to the junction of the resistors 26 and 27 at the lower end of the voltage divider by a capacitor 100. Accordingly, a 35 kHz signal is produced on the output line 13 whenever one of the switches 12 is operated, and the amplitude of the signal is approximately the same, irrespective of which switch is operated.

The output line 13 is connected by a resistor 102 to an input of one of four analog gates 104–107 contained within a gate unit 108. The output of the gate 104 is connected to the input of the gate 107. The output of the gate 107 is connected to a capacitor 112, which functions as a sample and hold capacitor. This capacitor is charged to the voltage level of the line 102A when the gates 104 and 107 are actuated. The resistor 102 in conjunction with the sample and hold capacitor 112 act as an RC filter which prevents the 35 kHz signal from affecting the voltage held on the capacitor 112. The gate 104 is normally actuated by a switch 111, and the gate 107 is operated in response to detection of the 35 kHz trigger signal generated by the multivibrator 8. The switch 111 can alternatively operate theh gates 105 and 106.

The trigger signal is detected by the trigger unit 7, which is connected to the output line 13 through a resistor 113 and a capacitor 114. The trigger unit 7 detects the presence of the 35 kHz signal on the keyboard bus 13. This technique of a.c. detection is equivalent to the detection of the a.c. impedance between the exponential voltage divider 14 and the bus 12. This a.c. impedance technique is used because it is extremely difficult to detect the d.c. voltage status of the bus 12 without perturbing the voltage of the sample and hold unit 5 or the divider 14. The unit 7 includes an operational transconductance amplifier 116, and the other end of the capacitor 114 is connected to the inverting input of the amplifier 116. The non-inverting input of the amplifier 116 is connected to a source of positive voltage determined by a potentiometer 118. Initial offset bias is supplied to the inverting input by a voltage divider incorporating resistors 120 and 122, connected from the potentiometer 118 to ground, with the junction of the resistors connected to the inverting input. A pair of diodes 124 and 126 are connected in parallel across the inverting and non-inverting inputs of the amplifier 116, in oppositely poled fashion, to limit the amplitude of signal which may be applied to the amplifier 116. The output of the amplifier is applied to a line 128, which is connected to a detector circuit comprising a diode 130 and a capacitor 132. A resistor 134 is connected in parallel with the capacitor 132 to provide for discharging the capacitor when no signal is detected by the trigger unit 7. When a 35 kHz signal is presented to the line 13, however, the amplifier 116 becomes conductive to draw current through the diode 130, charging the capacitor 132 and producing a relatively low potential on an output line 136.

The line 136 is connected to one input of an NAND gate 138, the other input of which is connected to a source of positive potential through a resistor 140, so that a positive potential is produced on a line 109 connected to the output of the NAND gate 138 as soon as the potential on the line 136 drops below about three volts. This positive potential is the triggering signal which is applied to the control input of the gate 107, via a line 109, to open the gate 107 and cause the capacitor 112 to be charged to a potential equal to that which is applied to the input of the gate 107.

A potentiometer 144 is connected between the signal input of the gate 104 and the input of the gate 105. When the gate 105 is actuated and the gate 104 is off, the capacitor 112 is not charged directly to the potential on the line 13 through the resistor 102 and the gate 107, but is charged through the resistor 102, the potentiometer 144, and the gate 107. This increases the time required for the capacitor 112 to change its voltage level, with the result that the potential glides from one level to another rather than passing directly from one level to another level. The gate 106 performs precisely the same function with respect to another potentiometer 146, so that either of two different amounts can be selected by energizing one of the two gates 105 and 106. One of the potentiometers 144 and 146 is conveniently located at a remote location, so that the position of its tap can readily be changed by the player during the course of a performance. In any case, eventually the capacitor 112 becomes changed to the potential present on the line 13.

Figure 3:
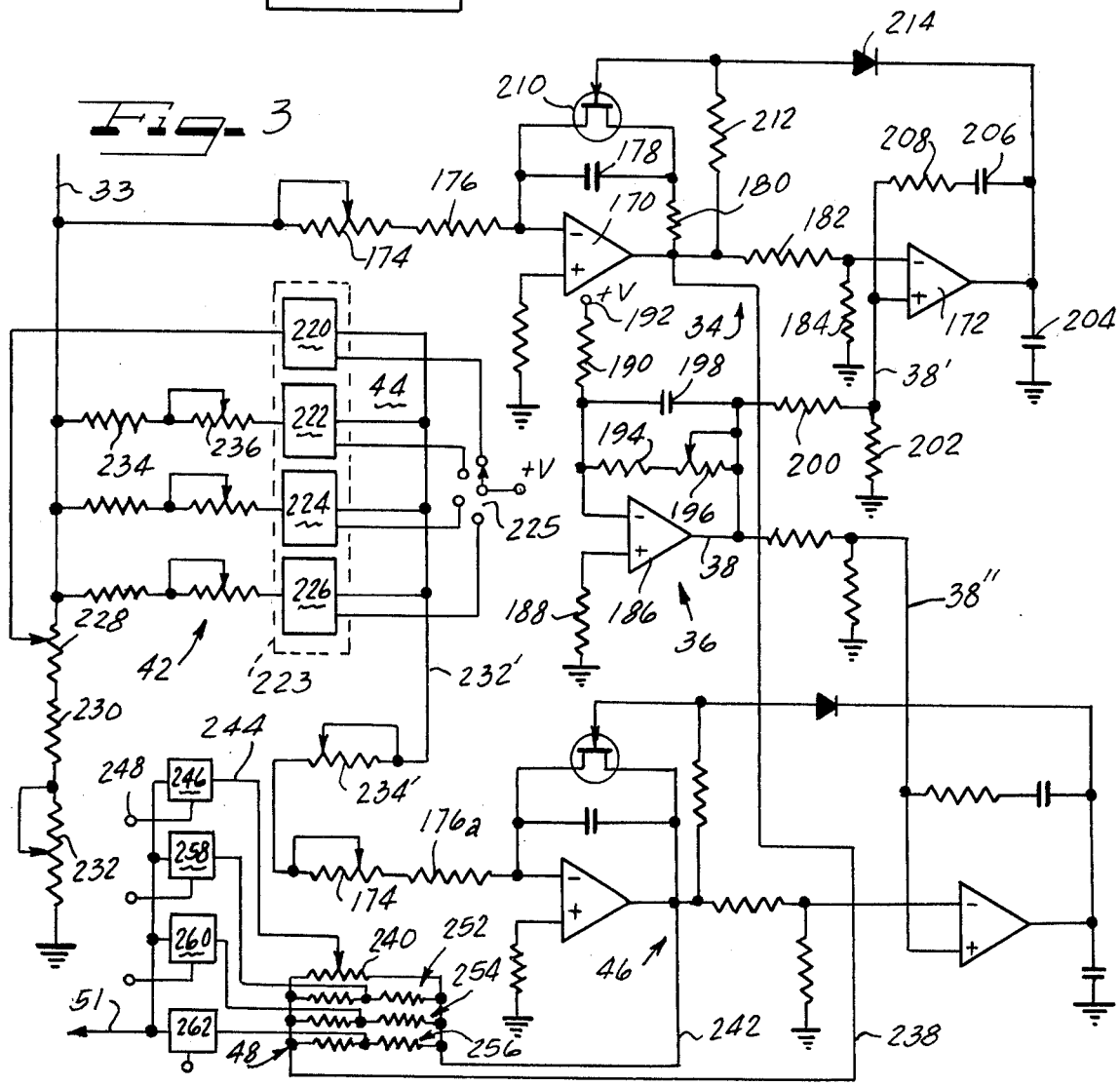
FIG. 3 is a schematic circuit diagram, partly in functional block diagram form, of an oscillator circuit employed in the musical instrument of FIG. 1.

The potential on the capacitor 112 is sensed by means of a high impedance amplifier 32 incorporating a pair of FET's 147 and 149, which are preferably formed in a single package, so they have the same characteristics. Both FET's are connected to a source of positive potential at a terminal 150, and the drain terminals of both FET's are connected through individual resistors 152 and 154 to opposite ends of a potentiometer 156, the tap of which is connected to a negative potential at a terminal 158. The potentiometer 156 is effective to select the same gain for the two FET's 147 and 149 by regulating the currents through the drain-source terminals of the two FET's. The two drain terminals are connected via lines 160 and 162 to the inverting and non-inverting inputs of an operational amplifier 164. The gate of the FET 147 is connected to the ungrounded terminal of the capacitor 112, and the gate of the FET 149 is connected to the output of the amplifier 164. The amplifier 32 functions as an extremely high impedance input amplifier with a relatively low impedance output. The potentiometer 156 is adjusted so that the voltage on the output line 33 of the amplifier 164 is precisely equal to the voltage presented by the capacitor 112. Because of the high input impedance of the amplifier 32, as well as the high impedance of the gate 107, when it is cut off, the voltage level on the capacitor 112 is substantially constant with time. Referring now to FIG. 3, a schematic circuit diagram, partly in functional block diagram form, shows the two oscillators which are controlled in response to the voltage selected by the key operated switches. The first or A oscillator 34 includes an operational amplifier 170, which functions as an integrator, and an operational amplifier 172, which functions both as a voltage comparator and as a monostable multivibrator.

The inverting input of the amplifier 170 is connected to the line 33 through a rheostat 174 and a resistor 176. A capacitor 178 is connected in series with a resistor 180 between the output of the amplifier 170 and its inverting input, so that the unit functions as an integrator, with the capacitor 178 being gradually charged, through the resistor 180, in response to a change in potential on the line 33. The output of the amplifier 170 is connected to a voltage divider including series connected resistors 182 and 184, and the output of the voltage divider, at the junction of the two resistors, is connected to the inverting input of the amplifier 172. The non-inverting input of the amplifier 172 is connected to the line 38′ on which the reference voltage appears.

The reference voltage generator 36 includes a differential amplifier 186, the non-inverting input of which is connected to ground through a resistor 188, with the inverting input being connected to a positive source of potential at a terminal 192 through a resistor 190. The potential applied to the terminal 192 is the same as that applied to the terminal 9, so that any variation in this voltage is applied equally to the voltage divider 60 and to the differential amplifier 186. The gain of the amplifier 186 is controlled by means of a series feedback circuit including a resistor 194 and a rheostat 196. A capacitor 198 is connected between the output of the amplifier 186 and its inverting input in order to prevent short-term fluctuations in the output of the amplifier 186. The rheostat 196 functions as a fine tuning control. By varying the resistance of the rheostat 196, the gain of the amplifier 186 is adjusted, and the voltage level on the line 38, connected to the output of the amplifier 186, is thereby changed. As will be more fully described hereinafter, this effects a change in tuning of the oscillator.

The line 38 is connected to the input of a voltage divider including resistors 200 and 202 connected in series to ground, and the line 38′ is connected to the junction of these two resistors.

As the voltage level on the line 38 is controlled by the output of the amplifier 186, and as the power supply is connected to the inverting input of the amplifier 186, any change in the power supply voltage relative to ground will be reflected in an opposite and proportionately equal change in the level applied to the line 38. The resistors 200 and 202 are chosen in relative value so that an increase in voltage level at the inverting input of the amplifier 172, due solely to a change in the supply voltage level, is fully compensated by a change in the voltage level on the line 38′, with the result that any variation in the supply voltage level does not affect operation of the amplifier 172.

The line 38 carries a constant voltage, determined by the position of the tap of the resistor 196, and the inverting input of the amplifier 172 is presented with a ramp function as the result of the integrating acting of the capacitor 178. The ramp increases in a negative direction from approximately 0 to approximately ½ V, as seen at the inverting input of the amplifier 172. When the level reaches approximately −½ V, it reaches equality with the level applied to the non-inverting input, and the output of the amplifier abruptly changes from approximately −15 V to approximately +11 V. A capacitor 204 connected from the output of the amplifier 172 to ground slows the transition in the voltage level at the output of the amplifier to eliminate undesired transients. A positive feedback is supplied from the output of the amplifier 172 to its non-inverting input through a series connected capacitor 206 and resistor 208.

As soon as the voltage levels at the two inputs of the amplifier 172 become equal, there is a major change in voltage at its output, and this voltage change is transferred by the feedback path to its non-inverting input, to perform a regenerative function. The time duration of the regenerative function is dependent upon the RC time constant of the circuit including the capacitor 206 and the resistor 208, which time constant is chosen to be about 10 microseconds. At the end of approximately 20 microseconds, the voltage at the non-inverting input of the amplifier 172 returns towards the −½ V level, and the amplifier 172 is then triggered back into conduction, to restore a −15 V level at its output. The positive feedback path connects this level to the non-inverting input, in order to maintain the non-inverting input low until the capacitor 170 has been discharged.

An FET 210 has its drain and source terminals connected across the capacitor 178, but the gate of the FET 210 is normally held low. A resistor 212 is connected from the output of the amplifier 170 through a diode 214 to the output of the amplifier 172, and the gate of the FET 210 is connected to the junction of the resistor 212 and the diode 214. As long as the output of the amplifier 172 remains low, current is drawn through the diode 214 and the resistor 212, and the FET 210 is cut off. This is the condition during the integration phase in which the capacitor 178 is charged. When the amplifier 172 is triggered, however, producing a positive voltage at its output, the diode 214 is back biased, so the gate of the FET 210 assumes the same potential as the output of the amplifier 170 and becomes conductive. The FET 210 is effective to completely discharge the capacitor 178 in about 20 microseconds, approximately the same time period as the astable operation of the amplifier 172, resulting from the positive feedback path including the capacitor 206 and the resistor 208. The capacitor 178 is fully discharged at the end of each ramp signal from the integrator amplifier 170, and when the amplifier 172 changes state again, a new integrating cycle is begun.

It should be appreciated that since the rate of integration, effected by the capacitor 178, is proportional to the voltage level applied thereto from the line 33, the time required for the ramp to reach a given level, relative to its starting level, is a function of the applied voltage, so that the frequency of the oscillator, as long as the supply voltage does not change, is directly proportional to the control voltage supplied to the oscillator. In the event that the supply voltage does change, a compensating change results in the reference voltage applied to the non-inverting input of the amplifier 172, so that the level at which the two inputs to the amplifier 172 reach equality changes in a way such as to compensate for the change in the supply voltage.

The second oscillator 46 is identical to the first oscillator 34, except that a different value is chosen for the coupling resistor 176a, because the B oscillator 46 is controlled to operate at a different frequency from the A oscillator 34. It is necessary, however, that the frequency of the second oscillator 46 track with the frequency of the oscillator 34, and so it is controlled by the same control voltage derived from line 33, and it is also compensated by the same reference voltage from the line 38 via the line 38''. The B oscillator 46 is caused to have a different scale factor, however, by which is meant that as the voltage on the line 33 is varied, the frequency of the B oscillator 46 is changed by a different amount. Preferably, the scale factor of the oscillator 46 is one-half that of the oscillator 34, meaning that only one-half as much voltage change on the line 33 is necessary to shift the frequency of the oscillator 46 by an octave. The tuning of the second oscillator is accomplished by the tuning unit 42, which incorporates a voltage divider reducing the voltage from that present on the line 33, so that both the oscillators 34 and 46 track together. The tuning unit 42 also incorporates a plurality of gates 220, 222, 224, and 226, for selecting different input resistances for the second integrating amplifier. When the gate 226 is energized, the potential supplied as a control voltage to the B oscillator 46 is derived from the line 33, through a voltage divider including a potentiometer 228, a resistor 230, and another potentiometer 232, all of which are connected in series from the line 33 to ground. The tap of the potentiometer 228 is connected through the gate 220 to an output line 232' connected in common to the outputs of all of the gates 220–226. The line 232' is connected through a pair of potentiometers 234' and **174*a* and the resistor 176*a* to the integrator amplifier of the B oscillator 46. The potentiometer 234' is very small in value and is used for making very fine corrections to the frequency of the oscillator 46.**

The several potentiometers are preferably adjusted as follows. With the gate 220 closed, the potentiometer 142 is adjusted (with the potentiometer 234' centered) so that when the tap of the potentiometer 228 is at its uppermost position, the frequency of the B oscillator 46 is 2.18 times that of the A oscillator 34. Thus, the frequency produced by the oscillator 46 is somewhat over an octave higher than that produced by the first oscillator 34. Then, without changing the settings of the potentiometers 234' and 174, and with the tap of the potentiometer 228 in its lowest setting, the potentiometer 232 is adjusted so that the frequency of the B oscillator 46 is approximately 91% of that of the A oscillator 34. Then the precise frequency of the second oscillator 46 (in relation to the first ocillator 34) may be selected by regulating the potentiometer 232, to produce the desired relationship and frequency between the two oscillators.

The three gates 222–226 function to connect the line 33 to the line 232' through three different circuits, each including an individual resistance. The first is connected from the line 33 through a resistor 234 and a variable resistor 236 to the signal input of the gate 222. The other two gates 224 and 226 have similar circuits including individual potentiometers, so that energization of any of these gates produces and individual relationship and frequency between two oscillators 34 and 46. The output circuits of the four gates 220–226 are all connected in common, so the output line 232' receives the output of whichever gate is energized by one of the lines 44. The gates 220–226 are analog gates contained in a single package 223, and one is selected by a switch 225.

The outputs of the two oscillators 34 and 46 are connected to two inputs of a mixer 48. A line 238 connects the output of the amplifier 170 to one end terminal of a potentiometer 240, and the oscillator 46 is connected to the opposite end of the potentiometer 240 by a line 242. The tap of the potentiometer 240 is connected by a line 244 to the signal input of a gate 246, the control input of which is connected to a terminal 248. When the control input 248 is energized, the signal on the line 244 is connected to the output line 51, which is connected to the power amplifier 52 and the loudspeaker 54 (FIG. 1).

In addition to the potentiometer 240, by which the outputs of the two oscillators may be mixed in an adjustable ratio, three fixed ratios are also provided by means of resistor networks 252, 254, and 256, by which different proportions of the signals from the A and B oscillators are mixed. The lines 238 and 242 are thereby connected, by resistors having different relative values, to the signal inputs of gates 258, 260, and 262. Each of these gates has an individual control line, by which one of the mixer networks is selected for connection to the output line 51.

By the foregoing, it will be appreciated that the present invention provides a voltage divider made up of individual resistor elements associated in exponential relation, so that a voltage is produced which is precisely proportional to the desired frequency, and that the compensation means described herein is effective fully to compensate for variations in environmental conditions.

Figure 4:
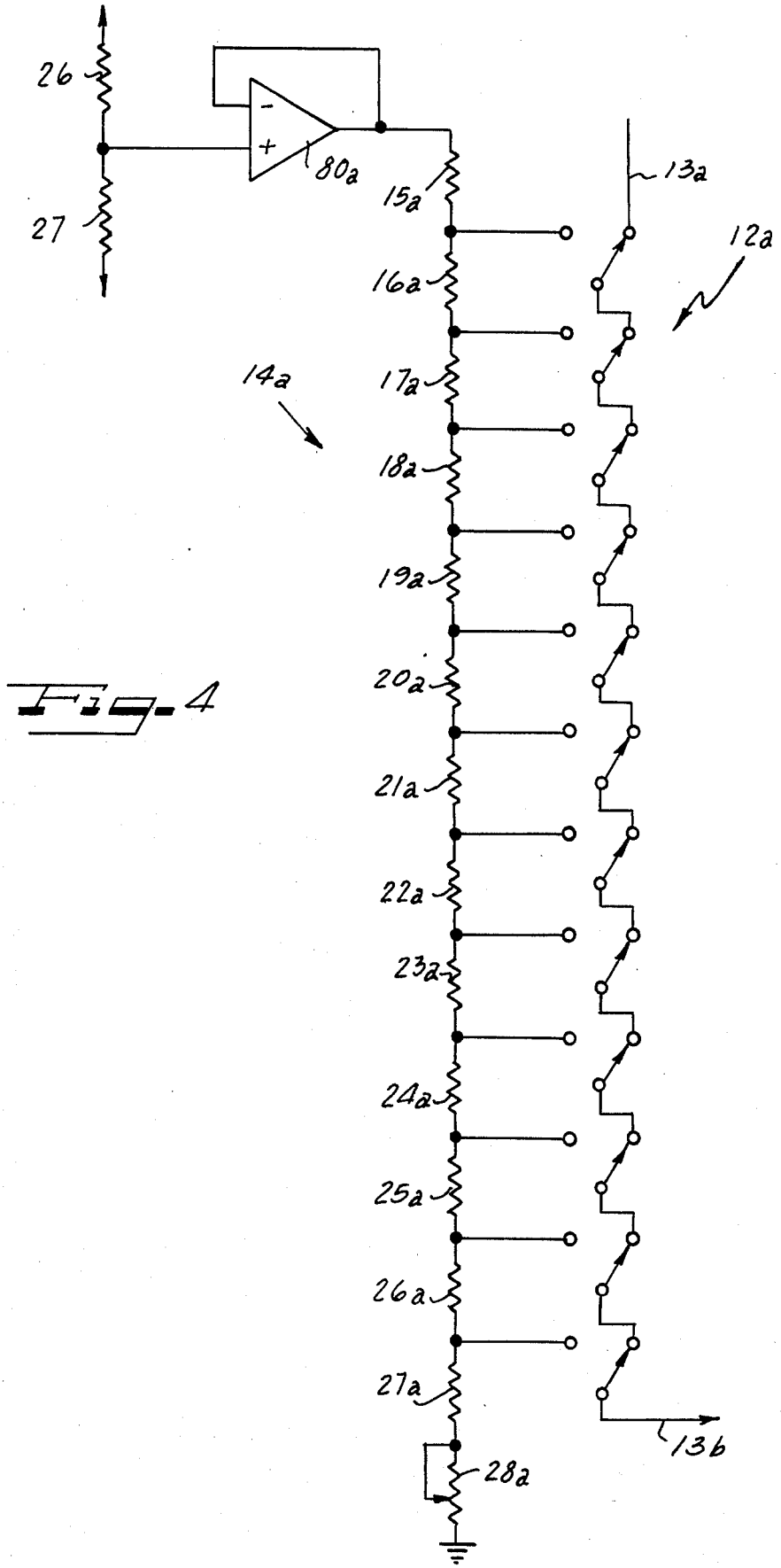
FIG. 4 is a functional block diagram of an alternative embodiment of the present invention.

In FIG. 4, an alternative arrangement of the present invention is shown, by which the range of musical sounds produced by the instrument may be extended over a range of more than one octave. The resistors 26 and 27 are the same resistors which are shown in FIG. 2, and they are connected in the same way as in FIG. 2 to other components (not shown). An additional connection is made to the junction of resistors 26 and 27, and connects the junction to the noninverting input of an operational amplifier **80*a*, which has its output connected to its inverting input and so has a voltage gain of unity. The output of the amplifier 80*a* is applied to one end of an exponential resistor string 14*a*, which is identical to the resistor string 14. The junctions between successive resistors of the string 14*a* are connected to contacts of a group of key switches 12*a*, which are identical to the switches 12 except that no switch is connected to the upper end of the resistor 15*a* because such a switch would be redundant. The switches 12*a* are connected in series and are operated by the keys of a second octave of the keyboard. This series connection is connected with the components of FIG. 2 as follows. The line 13 of FIG. 2 is disconnected from the resistors 102 and 113 and is connected instead to the line 13*a* of FIG. 4; the line 13*b* of FIG. 4 is connected to the resistors 102 and 113 of FIG. 1. Thus, the switches 12*a* are connected in series with the switches 12, and each switch selects a unique voltage for application to resistors 102 and 113.**

The various analog gates used throughout the system, such as the gates 89, 108, 223, 246, 258, 260, and 262, are preferably units such as 4016 integrated circuits, commercially available from RCA. The operational amplifiers such as 116, which is an operational transconductance amplifier, is preferably a model 3080, commercially available from RCA. Other operational amplifiers are preferably model 741 units, available from a number of sources.

Various modifications and additions may be made to the apparatus of the present invention without departing from the essential features of novelty thereof, which are intended to be defined and secured by the appended claims.

What is claimed is:

1. An electronic musical instrument having a voltage controlled oscillator for producing a sound signal having a frequency proportional to a control voltage applied to it, a keyboard having a plurality of keys, a plurality of switches, one for each of said keys, each adapted to be operated by depression of its associated key, and a voltage divider connected with said switches for connecting a control voltage to said oscillator which corresponds to the position of the key associated with an operated one of said switches, said voltage divider comprising a plurality of resistance elements connected in series, each of said elements having different resistance values which bear an exponential relation to the resistance values of the adjacent connected resistors such that the voltage at successive junctions of said resistance elements correspond to a geometric series, said resistance elements being formed of the same material and being physically located in close physical juxtaposition with each other, so that all said resistors are maintained at approximately the same temperature, with approximately constant relative resistances.

2. Apparatus according to claim 1 wherein said resistance elements are formed simultaneously as portions of a single integrated thick-film circuit.

3. In an electronic musical instrument having an electrical power supply, a voltage controlled oscillator for producing a sound signal having a frequency proportional to a control voltage applied to it, a keyboard having a plurality of keys, a plurality of switches, one for each of said keys, each adapted to be operated by depression of its associated key, and connecting means connected with said switches for connecting a control voltage to said oscillator which corresponds to the position of the key associated with an operated one of said switches, the combination comprising a reference voltage generator connected to said electrical power supply for producing a reference voltage, and means connecting said oscillator to said reference voltage generator, said reference voltage generator being adapted to produce a shift in the level of said reference voltage in response to a change in the level of voltage of said electrical power supply, said shift having a magnitude and direction tending to compensate for said change in power supply voltage level, whereby said oscillator frequency is substantially independent of said change.

4. Apparatus according to claim 3, wherein said reference voltage generator comprises an inverter having an input connected with said power supply.

5. Apparatus according to claim 4, wherein said oscillator comprises an integrator for integrating a voltage derived from said voltage divider, a comparator connected to said integrator and operative to compare an output produced by said integrator with said reference voltage, and means connected with said comparator and operative upon a comparison of said integrator output and said reference voltage for resetting said integrator for a subsequent cycle of integration.

6. An electronic musical instrument having a voltage controlled oscillator for producing a sound signal having a frequency proportional to a control voltage applied to it, a keyboard having a plurality of keys, a plurality of switches, one for each of said keys, each adapted to be operated by depression of its associated key, a voltage divider connected with said switches for connecting a control voltage to said oscillator which corresponds to the position of the key associated with an operated one of said switches, said voltage divider comprising a plurality of resistance elements connected in series, each of said elements having resistance values which bear an exponential relation to the resistance values of adjacent connected resistors such that the voltage at successive junctions of said resistance elements correspond to a geometric series, means for supplying a selected potential across said series circuit, whereby said control voltage is dependent both on which of said switches is operated and on the selected potential, and selector means for selecting one of a plurality of potentials for application to said series circuit.

7. Apparatus according to claim 6, wherein said selector means comprises means for selecting one of a plurality of discrete voltage levels for application to said series circuit, said discrete voltage levels differing from each other by factors which are powers of two, whereby the frequency of said sound signal falls within an octave selected by said selector means.

8. Apparatus according to claim 6, including means for producing an a.c. signal, means for coupling said a.c. signal to said voltage divider, and detector means connected with said control voltage for developing a signal in response to detection of said a.c. signal following depression of one of said keys.

9. An electronic musical instrument having a first voltage controlled oscillator for producing a sound signal having a frequency proportional to a control voltage applied to it, a keyboard having a plurality of keys, a plurality of switches, one for each of said keys, each adapted to be operated by depression of its associated key, a voltage divider connected with said switches for connecting a control voltage to said oscillator which corresponds to the position of the key associated with an operated one of said switches, said voltage divider comprising a plurality of resistance elements connected in series, each having resistance values which bear an exponential relation to the resistance values of adjacent connected resistors, such that the voltage at successive junctions of said resistance elements corresponds to a geometric series, a second voltage controlled oscillator, and tuning means for connecting said control voltage to said second oscillator, said tuning means being operative to modify said control voltage whereby said second oscillator oscillates at a frequency which differs from the frequency of the first oscillator by a constant factor.

10. Apparatus according to claim 9, wherein said tuning means includes manually adjustable means for selecting a predetermined relationship between the frequencies of said first and second oscillators.

* * * * *